US007040513B2

(12) United States Patent
Pardonge

(10) Patent No.: US 7,040,513 B2
(45) Date of Patent: May 9, 2006

(54) METERING VALVE FOR DISPENSING A FLUID

(75) Inventor: Jean-Marc Pardonge, Saint Ouen (FR)

(73) Assignee: Valois SAS, Le Neubourg (FR)

( * ) Notice: Subject to any disclaimer, the term of this patent is extended or adjusted under 35 U.S.C. 154(b) by 14 days.

(21) Appl. No.: 10/844,363

(22) Filed: May 13, 2004

(65) Prior Publication Data

US 2004/0226970 A1 Nov. 18, 2004

Related U.S. Application Data

(60) Provisional application No. 60/485,387, filed on Jul. 9, 2003.

(30) Foreign Application Priority Data

May 15, 2003 (FR) ..... 03 05857

(51) Int. Cl.
*B65D 85/00* (2006.01)

(52) U.S. Cl. ..... 222/402.1

(58) Field of Classification Search ..... 222/402.1
See application file for complete search history.

(56) References Cited

U.S. PATENT DOCUMENTS

| | | | |
|---|---|---|---|
| 2,980,301 | A | 4/1961 | De Gorter |
| 3,176,889 | A | 4/1965 | Potapenko et al. |
| 3,269,615 | A | 8/1966 | Ferry, Jr. |
| 4,506,803 | A | 3/1985 | Franklin et al. |

FOREIGN PATENT DOCUMENTS

| | | | |
|---|---|---|---|
| GB | 1 201 918 | A | 8/1970 |

*Primary Examiner*—Philippe Derakshani
(74) *Attorney, Agent, or Firm*—Sughrue Mion, PLLC

(57) ABSTRACT

A metering valve for dispensing a fluid, the metering valve having a valve body (10) and a valve member (20) mounted to slide relative to the valve body (10) between a rest position and a dispensing position. The valve further has a metering chamber (11) serving to contain the metered quantity or "dose" of fluid discharged each time the valve is actuated, and when the metering valve is in the rest position, the metering chamber (11) is at atmospheric pressure.

10 Claims, 1 Drawing Sheet

METERING VALVE FOR DISPENSING A FLUID

CROSS REFERENCE TO RELATED APPLICATION

This application claims the benefit under 35 U.S.C. §119 (e) of pending U.S. provisional patent application Ser. No. 60/485,387, filed Jul. 9, 2003, and priority under 35 U.S.C. §119(a)–(d) of French patent application No. FR-03.05857, filed May 15, 2003.

TECHNICAL FIELD

The present invention relates to a metering valve and to a fluid dispenser device including such a valve.

BACKGROUND OF THE INVENTION

Metering valves are well known from the state of the art, in particular for dispensing fluids in liquid or powder form. The fluid is generally associated with a propellant gas, and actuating the valve makes it possible to dispense a metered quantity or "dose" of fluid by means of said propellant gas. A metering valve generally includes a valve body defining a metering chamber, the valve member sliding in said metering chamber between a rest position and a dispensing position. When the valve member is in the rest position, said valve member is not connected to the inside of the metering chamber, and the metering chamber is connected to the reservoir so that it can be filled, generally by gravity, with the fluid and with the propellant gas, so as to define the dose of fluid to be dispensed the next time the valve is actuated. When the valve is actuated, the valve member is pushed into the valve body, and the passageway between the metering chamber and the reservoir is closed. Then, when the valve member reaches the vicinity of its dispensing position, the metering chamber is connected to the dispensing orifice of the valve member, thereby enabling the dose of fluid contained in the metering chamber to be discharged through the dispensing orifice of the valve member. When the user ceases to press on the valve member, said valve member is returned automatically to its rest position by a return spring, and, during this operation, the metering chamber fills again with the fluid and with the propellant gas, generally by gravity when the valve is a valve used in the upside down position, i.e. with the metering valve under the reservoir. In known metering valves, the metering chamber is thus at the same pressure as the reservoir when the valve is in the rest position because said chamber is connected directly to said reservoir. This implies high stresses on the gaskets provided at the metering chamber, and risks causing fluid to return towards the reservoir during storage, when the valve is stored in the upright position. In order to avoid such fluid return from the metering chamber to the reservoir while the valve is being stored in the upright position, and thus in order to avoid reducing the next dose, the valve member is generally provided with internal channels of complex shapes, e.g. siphon shaped, but because of the pressure existing in the metering chamber, sustaining the full dose, and therefore metering accuracy are not absolutely guaranteed.

In addition, in known metering valves, the return spring of the valve member is disposed in the body of the valve, and generally at the passageway connecting the metering chamber to the reservoir. The spring is thus in contact with the fluid and with the propellant gas. Depending on the material of the spring (generally metal) and on the type of the fluid, this can degrade said fluid.

SUMMARY OF THE INVENTION

An object of the present invention is to provide a metering valve that does not reproduce the above-mentioned drawbacks.

More particularly, an object of the present invention is to provide a metering valve that guarantees absolute metering accuracy each time the valve is actuated, as well as full dose reproducibility each time it is actuated.

An object of the present invention is also to provide such a metering valve in which metering accuracy and dose reproducibility are independent of the time for which the valve is stored between occasions on which it is actuated.

Another object of the present invention is to provide such a valve that avoids any risk of degrading the fluid, even when the valve is stored for a prolonged period.

An object of the present invention is also to provide such a metering valve that is simple and inexpensive to manufacture and to assemble, and that is reliable to use.

The present invention therefore provides a metering valve for dispensing a fluid, said metering valve comprising a valve body and a valve member mounted to slide relative to said valve body between a rest position and a dispensing position, said valve further comprising a metering chamber serving to contain the metered quantity or "dose" of fluid discharged each time the valve is actuated, said metering valve being characterized in that, when it is in the rest position, said metering chamber is at atmospheric pressure.

Advantageously, the valve further comprises a filling chamber connected firstly to a fluid reservoir and secondly to said metering chamber, the passageway between the metering chamber and the filling chamber being closed when the valve is in the rest position and in the dispensing position, said passageway being open when the valve moves between its rest position and its dispensing position.

Advantageously, said filling chamber is connected to said fluid reservoir when the valve is in the rest position, the passageway between the filling chamber and the reservoir being closed when the valve is not in the rest position.

Advantageously, the metering chamber fills when the valve member moves from its rest position to its dispensing position.

Advantageously, said valve member is provided with a link channel having an inlet and an outlet that is offset axially relative to said inlet, said link channel lying entirely within the metering chamber in the rest position, lying entirely within the filling chamber in the dispensing position, and connecting said metering chamber to said filling chamber when the valve member is between its rest position and its dispensing position, said inlet then being disposed in the filling chamber, and said outlet being disposed in said metering chamber.

Advantageously, the fluid contained in the metering chamber is discharged when the valve member reaches its dispensing position.

Advantageously, a spring urges the valve member towards its rest position, said spring being disposed out of any contact with said fluid.

Advantageously, the valve body further comprises a spring chamber isolated from any contact with the fluid, the valve member passing through said spring chamber, and the spring being disposed in said spring chamber around said valve member.

Advantageously, the valve member is provided with a central discharge channel connecting the dispensing orifice of the valve member to an opening that opens out into the metering chamber when the valve member is in the dispensing position, said opening being isolated from said metering chamber when the valve member is not in the dispensing position.

Advantageously, the valve body comprises a spring chamber, a metering chamber, and a filling chamber, the spring chamber being separated from the metering chamber by a first transverse wall, the metering chamber being separated from the filling chamber by a second transverse wall, and the filling chamber being separated from the reservoir by a third transverse wall, said valve member sliding through said spring chamber, said metering chamber, and said filling chamber between its rest position and its filling position, by passing in leaktight manner through said first, second, and third transverse walls.

The present invention also provides a fluid dispenser device including a metering valve as described above.

BRIEF DESCRIPTION OF THE DRAWINGS

Other characteristics and advantages of the present invention appear more clearly from the following detailed description of a particular embodiment of it, given with reference to the accompanying drawings which are given by way of non-limiting example, and in which.

DETAILED DESCRIPTION OF THE INVENTION

The figures show a metering valve including a valve body 10. The valve is assembled to a reservoir (not shown) which contains fluid, e.g. a liquid or a powder, generally associated with a propellant gas serving to enable the fluid to be dispensed through said valve. The valve body 10 may be assembled to said reservoir (not shown) by means of a fixing ring or of a fixing cap, in particular a crimp-on cap 5, preferably with a valve member gasket 6 being interposed between the valve body 10 and said crimp-on cap 5, and with a neck gasket (not shown) being interposed between the neck of the reservoir (not shown) and said crimp-on cap 5. In the example shown in the figures, the valve body 10 has a thicker end edge 7 that serves to be fixed into said crimp-on cap 5. Optionally, in particular when the valve is designed to be used in the upside down position, as it is in the example shown in the figures, the valve body 10 may be associated with a packing ring (not shown) serving to pack the dead volume between the reservoir neck and the crimp-on cap 5 at least in part, and/or to limit the contact between the fluid and the valve member gasket 6.

Figure 1:
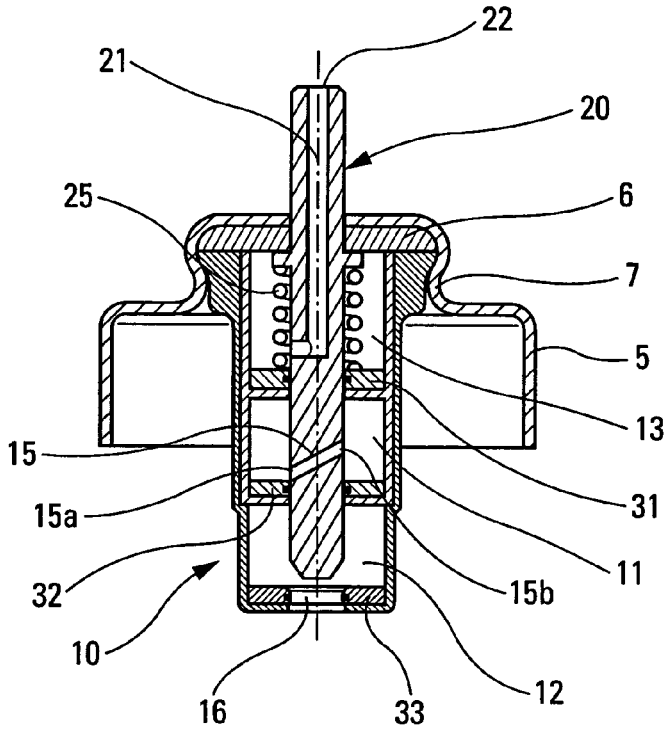
FIG. 1 is a diagrammatic section view of a metering valve of the present invention, when the valve is in the rest position.
Figure 2:
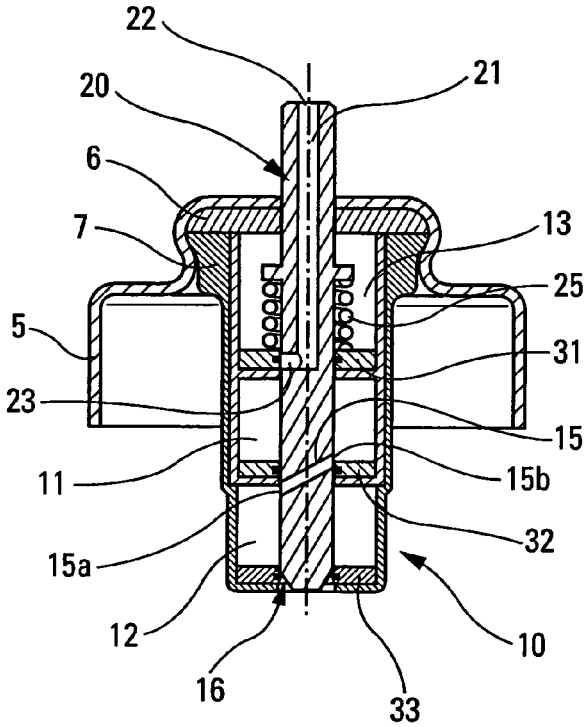
FIG. 2 is a view similar to the view in FIG. 1, when the valve is in an intermediate position, between the rest position and the dispensing position.

In the present invention, the valve body 10 includes a metering chamber 11 serving to contain a dose of fluid, which dose of fluid is dispensed whenever the valve is actuated. In the present invention, said metering chamber 11 is at atmospheric pressure when the valve is in the rest position. In other words, the metering chamber 11 is isolated from the fluid reservoir when the valve is in the rest position, so that no extra pressure is exerted on the gaskets defining said metering chamber 11 during storage, and so that there is no risk of the dose of fluid being reduced due to prolonged storage because, during storage, the metering chamber 11 is empty and does not contain any fluid. In the present invention, the metering chamber 11 fills only when the valve member 20, which slides in the valve body 10, moves from its rest position (shown in FIG. 1) to its dispensing position (shown in FIG. 3). The metering chamber 11 is filled between said rest position and said filling position, in the intermediate position shown in FIG. 2. For this purpose, the valve member 20 has a link channel 15 forming a passageway between the metering chamber 11 and a filling chamber 12 provided in the valve body 10. The link channel is closed when the valve is in the rest position, in which said channel is disposed entirely within the metering chamber 11. Similarly, said channel 15 is closed when the valve is in the dispensing position in which said channel is disposed entirely within the filling chamber 12. It is only in the intermediate position shown in FIG. 2 that the link channel 15 connects the filling chamber 12 to the metering chamber 11. As shown in the figure, the link channel 15 may have an inlet 15*a* and an outlet 15*b*, said inlet 15*a* being disposed in the filling chamber 12 and said outlet 15*b* being disposed in the metering chamber 11, when the valve is in the intermediate position. When the valve member 20 reaches the intermediate position in which the link channel 15 connects the metering chamber 11 to the filling chamber 12, the metering chamber 11 fills very rapidly due to the difference in pressure between the metering chamber and the filling chamber. Advantageously, said difference in pressure detaches any active fluid that is stuck to the walls of the filling chamber 12, thereby guaranteeing that a full dose of active fluid is dispensed each time the valve is actuated.

Preferably, the filling chamber 12 is connected to the reservoir (not shown) when the valve is in the rest position. Conversely, whenever the valve member 20 is actuated and it is moved axially inside the valve body, the passageway 16 between the filling chamber 12 and the reservoir is closed, thereby isolating said filling chamber 12 from said reservoir. Advantageously, the volume of the filling chamber 12 corresponds to the volume of the metering chamber 11, so that, when the valve member goes into the intermediate position, the entire contents of the filling chamber 12 is emptied into the metering chamber 11 via the link channel 15.

Figure 3:
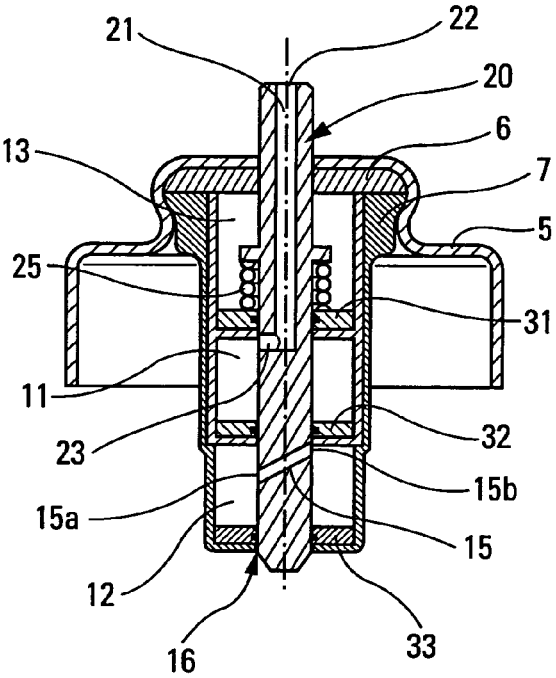
FIG. 3 is a view similar to the views of FIGS. 1 and 2, when the valve is in the dispensing position.

In known manner, the valve member 20 is provided with an axial discharge channel 21 that opens out in a dispensing orifice 22, said discharge channel 21 having an inlet orifice 23. The inlet orifice 23, which is generally radial, is organized to open out in the metering chamber 11 when the valve member is in the dispensing position. This means that the dose-of fluid contained in the metering chamber 11 is discharged through the valve member 20 when said valve member reaches the dispensing position, which is shown in FIG. 3, and which corresponds to the position in which the valve member 20 is pushed into the valve body 10. When the valve member 20 returns from its dispensing position to its rest position, the link channel 15 goes back through the intermediate position in which it connects the filling chamber 12 to the metering chamber 11. However, during this return stroke, the filling chamber 12 is empty and is isolated from the reservoir, as is the metering chamber 11, so that said passageway causes no modification in the state of said chambers, and in particular does not fill the metering chamber 11. Thus, when the valve member 20 comes into the vicinity of its rest position again, the metering chamber 11 is still at atmospheric pressure, as it was after the dose was dispensed when the valve was actuated the preceding time. The metering chamber 11 is thus at atmospheric pressure when the valve is in the rest position. Conversely, when the valve member 20 comes into its rest position, the filling chamber 12 is once again connected to the reservoir (not shown) via the passageway 16, which enables said filling chamber 12 to be filled, in particular by gravity when the valve is used in the upside down position.

Advantageously, the valve body 10 also includes a spring chamber 13 in which the spring 25 that urges the valve member 20 into its rest position is disposed. Advantageously, said spring 25 is disposed out of any contact with the fluid, as shown in the figures. This is obtained because the spring chamber 13 is disposed in the valve body 10 while being separated in leaktight manner from the metering chamber 11, the valve member sliding in leaktight manner in said spring chamber 13, and the spring 25 being disposed around said valve member 20 in said spring chamber 13. Advantageously, the spring chamber 13 is separated from the metering chamber 11 by a first transverse wall 31 that is preferably associated with a sealing gasket against which said valve member 20 slides in leaktight manner. Similarly, said metering chamber 11 is separated in leaktight manner from the filling chamber 12 by a second transverse wall 32 which is also preferably associated with a gasket against which said valve member 20 slides in leaktight manner. Finally, the filling chamber 12 may also be advantageously separated from the reservoir (not shown) by a third wall 33, also preferably associated with a gasket against which said valve member 20 slides in leaktight manner. Thus, the only link between the reservoir and the filling chamber 12 is provided by the passageway 16 which is closed as soon as the valve member 20 is no longer in the rest position. The only link between the filling chamber 12 and the metering chamber 11 is provided by means of the link channel 15, which link channel is open only when the valve member 20 is in the intermediate position situated between its rest position and its dispensing position. Finally, the spring chamber 13 is never connected to the metering chamber 11, or to the filling chamber 12, or to the reservoir, so that the spring 25 is completely isolated from any contact with the fluid.

This embodiment is particularly advantageous in that it guarantees firstly that the metering chamber 11 is at atmospheric pressure when the valve is in the rest position, which is particularly advantageous, in particular when the times between two occasions on which the valve is actuated are relatively long, and secondly that the spring 25 is never in contact with the fluid, thereby avoiding any risk of the fluid being degraded due to contact with the spring, which is generally made of metal.

It should be noted that the spring may also be disposed at the bottom of the valve body, e.g. in the filling chamber, so as to limit the number of gaskets. In which case however, it is in contact with the fluid.

The present invention thus makes it possible to obtain a metering valve that is particularly reliable, that guarantees that the dose is reproduced exactly and in full each time the valve is actuated while also being simple in construction and reliable to operate.

Although the present invention is described with reference to a particular embodiment of it, it is naturally not limited to the embodiment shown in the drawings, but rather the person skilled in the art may make any necessary modifications to it without going beyond the ambit of the present invention, as defined by the accompanying claims.

The invention claimed is:

1. A metering valve for dispensing a fluid, said metering valve comprising a valve body (10) and a valve member (20) mounted to slide relative to said valve body (10) between a rest position and a dispensing position, said valve further comprising a metering chamber (11) serving to contain the metered quantity of fluid discharged each time the valve is actuated, wherein, when said metering valve is in the rest position, said metering chamber (11) is at atmospheric pressure; and wherein the valve further comprises a filling chamber connected firstly to a fluid reservoir and secondly to said metering chamber, a passageway between the metering chamber and the filling chamber being closed when the valve is in the rest position and in the dispensing position, said passageway being open when the valve moves between the rest position and the dispensing position.

2. A valve according to claim 1, in which said filling chamber (12) is connected to said fluid reservoir when the valve is in the rest position, the passageway (16) between the filling chamber (12) and the reservoir being closed when the valve is not in the rest position.

3. A valve according to claim 1, in which the metering chamber (11) fills when the valve member (20) moves from its rest position to its dispensing position.

4. A valve according to claim 1, in which said valve member (20) is provided with a link channel (15) having an inlet (15*a*) and an outlet (15*b*) that is offset axially relative to said inlet (15*a*), said link channel (15) lying entirely within the metering chamber (11) in the rest position, lying entirely within the filling chamber (12) in the dispensing position, and connecting said metering chamber (11) to said filling chamber (12) when the valve member (20) is between its rest position and its dispensing position, said inlet (15*a*) then being disposed in the filling chamber (12), and said outlet (15*b*) being disposed in said metering chamber (11).

5. A valve according to claim 1, in which the fluid contained in the metering chamber (11) is discharged when the valve member (20) reaches its dispensing position.

6. A valve according to claim 1, in which a spring (25) urges the valve member (20) towards its rest position, said spring (25) being disposed out of any contact with said fluid.

7. A valve according to claim 6, in which the valve body (10) further comprises a spring chamber (13) isolated from any contact with the fluid, the valve member (20) passing through said spring chamber (13), and the spring (25) being disposed in said spring chamber (13) around said valve member (20).

8. A valve according to claim 1, in which the valve member (20) is provided with a central discharge channel (21) connecting the dispensing orifice (22) of the valve member (20) to an opening (23) opening that opens out into the metering chamber (11) when the valve member (20) is in the dispensing position, said opening (23) being isolated from said metering chamber (11) when the valve member (20) is not in the dispensing position.

9. A valve according to claim 1, in which the valve body (10) comprises a spring chamber (13), a metering chamber (11), and a filling chamber (12), the spring chamber (13) being separated from the metering chamber (11) by a first transverse wall (31), the metering chamber (11) being separated from the filling chamber (12) by a second transverse wall (32), and the filling chamber (12) being separated from the reservoir by a third transverse wall (33), said valve member (20) sliding through said spring chamber (13), said metering chamber (11), and said filling chamber (12)

between its rest position and its filling position, by passing in leaktight manner through said first, second, and third transverse walls (31, 32, 33).

10. A fluid dispenser device comprising a metering valve comprising a valve body (10) and a valve member (20) mounted to slide relative to said valve body (10) between a rest position and a dispensing position, said valve further comprising a metering chamber (11) serving to contain the metered quantity of fluid discharged each time the valve is actuated, wherein, when the valve is in the rest position, said metering chamber (11) is at atmospheric pressure; and wherein the valve further comprises a filling chamber connected firstly to a fluid reservoir and secondly to said metering chamber, a passageway between the metering chamber and the filling chamber being closed when the valve is in the rest position and in the dispensing position, said passageway being open when the valve moves between its rest position and its dispensing position.

* * * * *